United States Patent [19]

Torii et al.

[11] Patent Number: 4,910,087

[45] **Date of Patent: * Mar. 20, 1990**

[54] HEAT-SENSITIVE RECORDING MEDIUM

[75] Inventors: Hideyasu Torii, Kawagoe; Kazuyuki Hanada, Saitama, both of Japan

[73] Assignees: Dainichiseika Color & Chemicals Mfg. Co., Ltd.; Ukima Colour & Chemicals Mfg. Co., Ltd., both of Tokyo, Japan

[ * ] Notice: The portion of the term of this patent subsequent to Dec. 12, 2008 has been disclaimed.

[21] Appl. No.: 90,100

[22] Filed: Aug. 27, 1987

[51] Int. Cl.[4] ..... B41M 5/26

[52] U.S. Cl. ..... 428/423.1; 428/195; 428/423.7; 428/447; 428/480; 428/483; 428/484; 428/488.4; 428/524; 428/913; 428/914

[58] Field of Search ..... 428/195, 447, 484, 488.1, 428/488.4, 913, 914, 423.1, 423.7, 480, 483, 524; 503/227

[56] References Cited

U.S. PATENT DOCUMENTS 4,735,860 4/1988 Mizobuchi et al. ..... 428/447

FOREIGN PATENT DOCUMENTS 138483 4/1985 European Pat. Off. ..... 428/488.4
219096 11/1985 Japan ..... 428/488.4

*Primary Examiner*—Pamela R. Schwartz
*Attorney, Agent, or Firm*—Oblon, Spivak, McClelland, Maier & Neustadt

[57] ABSTRACT

A heat-sensitive recording medium is composed of a base sheet, a heat-sensitive recording layer provided on one side of the base sheet and a heat-resistant layer provided on the other side of the base sheet. The heat-resistant layer is made of a resin containing siloxane bonds in its molecule.

3 Claims, No Drawings

HEAT-SENSITIVE RECORDING MEDIUM

BACKGROUND OF THE INVENTION (1) Field of the Invention

This invention relates to a heat-sensitive recording medium, and more specifically to a heat-sensitive recording medium useful in the practice of the thermal ink-transfer recording or sublimation ink-transfer recording method.

(2) Description of the Prior Art

It has heretofore been known to have a dye or pigment carried along with a heat-sensitive binder resin on one side of a sheet-like base material such as polyester film to form a recording layer (ink layer) and to heat the recording layer in a desired pattern by way of the back side of the base material to transfer the ink onto a recording material. It has also been known to use a thermally-sublimable dye as the above dye and to transfer the dye alone in a similar manner.

Since thermal energy is applied through the back side of a sheet-like base material in such conventional methods, the back side of the sheet-like base material is required to have sufficient heat resistance so that a thermal head does not stick on the back side.

It has hence been practised in the prior art to form a heat-resistant layer of a resin having relatively good heat resistance, for example, a polyurethane resin, acrylic resin, polyester resin, modified cellulose resin or a mixture thereof on the back side of a sheet-like base material of a heat-sensitive recording medium.

Although such conventional heat-sensitive recording media are provided on the back sides thereof with a heat-resistant layer of such a resin as mentioned above, these resins are thermoplastic and do not have sufficient resistance to heat. They are thus accompanied by a drawback that they tend to stick a thermal head to render insufficient the release property of the thermal head from the heat-sensitive recording medium.

It has been attempted to incorporate an inorganic filler such as talc or fluoroplastic powder in such a heat-resistant layer with a view toward providing a solution to these drawbacks. Heat-resistant layers containing such a filler or powder are however accompanied by drawbacks that due to the existence of such powder on their surfaces too, thermal heads are subjected to considerable smearing and wearing and their service life is shortened substantially in spite of their high price.

These various drawbacks can be solved by using a resin whose softening point and melting point are very high. There is however no suitable solvent for so-called heat-resistant resins known to date, so that difficulties still remain regarding their application on sheet-like base materials. Even if they can be applied, layers formed of these conventional heat-resistant resins have insufficient adhesion to sheet-like base materials and moreover are hard and brittle. It has hence been unable to form heat-resistant layers equipped with sufficient flexibility. It has therefore been unable to use such heat-resistant resins actually.

It has hence been desired to develop a resin having not only excellent flexibility but also superb heat resistance so that the above-mentioned problems can be solved.

SUMMARY OF THE INVENTION

The present inventors have carried out an extensive investigation with a view toward solving the above-mentioned drawbacks of the prior art and meeting the above desire in the present field of art. As a result, it has been found that the above-mentioned drawbacks of the prior art technology can be solved by using a specific resin for the formation of a heat-resistant layers, leading to completion of this invention.

In one aspect of this invention, there is thus provided a heat-sensitive recording medium composed of a base sheet, a heat-sensitive recording layer provided on one side of the base sheet and a heat-resistant layer provided on the other side of the base sheet. The heat-resistant layer is made of a resin modified containing siloxane bonds in its molecule.

As will be demonstrated in Examples to be described subsequently, the heat-resistance of the heat-resistant layer in the heat-sensitive recording medium of this invention is very high and the softening point of the heat-resistant layer is also very high because the heat-resistant layer is formed of a resin containing polysiloxane bonds in its molecule, preferably, a polyurethane resin and/or polyurea resin.

This significant advantage seems to be attributable to the fact that the specific resin useful in the practice of this invention contains siloxane bonds in a significant proportion. In particular, a polyurethane resin and/or polyurea resin also contain strong hydrogen bonds between its urethane bonds and/or between its urea bonds. The above-mentioned advantage may be attributed not only to siloxane bonds but also these hydrogen bonds.

In contrast to heat-sensitive recording media according to the prior art, the heat-resistant layer of the heat-sensitive recording medium of this invention is not softened and rendered sticky by heat from a thermal head. The heat-sensitive recording medium of this invention can hence be used while enjoying its extremely high stability.

The above and other objects, features and advantages of the present invention will become apparent from the following description and the appended claims.

DETAILED DESCRIPTION OF THE INVENTION AND PREFERRED EMBODIMENTS

The resin, which is useful in the practice of this invention and is a principal feature of the present invention, features inclusion of siloxane bonds in its molecule. As its preferred specific examples, may be mentioned those containing residual of a polysiloxane polyol or polyamine, which is represented by the following general formula (I), in the polymer backbones.

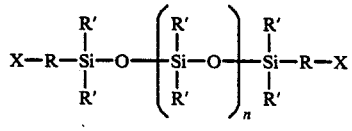

(I)

wherein X means an amino or hydroxyl group, R denotes a divalent aliphatic, aromatic or aliaromatic with a $C_1$–$C_6$ alkyl group or $C_6$–$C_{10}$ aromatic group being particularly preferred, R′ stands for a $C_1$–$C_6$ alkyl group with a methyl group being especially preferred, and n is a value to give an average molecular weight of about 500–10,000 for the above compound with an average molecular weight of about 1,000–5,000 being particularly preferred.

The following resins may be mentioned by way of example as resins which contain such polysiloxane segments as described above and are usable in the present invention.

(1) Where X is an amino group, polyamide resins which are each obtained by polycondensation with a polycarboxylic acid while making use of the amino groups.

(2) Where X is a hydroxyl group, polyester resins which are each obtained by polycondensation with a polycarboxylic acid while making use of the hydroxyl groups.

(3) Where X is a hydroxyl group, polyurethane resins which are each obtained by addition-polymerization with an organic polyisocyanate while making use of the hydroxyl group.

(4) Where X is an amino group, polyurea resins which are each obtained by addition-polymerization with an organic polyisocyanate while making use of the amino groups.

(5) Polyurethane polyurea resins which are each obtained by using a polysiloxane segment (X: amino group) and another polysiloxane segment (X" hydroxyl group) in combination and then addition-polymerizing them with an organic polyisocyanate.

Among such various siloxane-bond-containing resins as described above, the polyurethane resins and/or polyurea resins (3)–(5) are particularly preferred in the present invention.

These preferred resins will next be described more specifically. The following organic polyisocyanates may be mentioned by way of example as those preferable for obtaining polyurethane resins, polyurea resins or polyurethane polyurea resins by reacting them with the above-described polysiloxane polyamines and/or polyols.

Toluene-2,4-diisocyanate;
4-Methoxy-1,3-phenylenediisocyanate;
4-Isopropyl-1,3-phenylencdiisocyanate;
4-Chloro-1,3-phenylenediisocyanate;
4-Butoxy-1,3-phenylenediisocyanate;
2,4-Diisocyanato diphenyl ether;
Mesitylenediisocyanate;
4,4-Methylenebis(phenyl isocyanate);
Durylenediisocyanate;
1,5-Naphthalenediisocyanate;
Benzidinediisocyanate;
o-Nitrobenzidinediisocyanate;
4,4-Diisocyanato-dibenzyl;
1,4-Tetramethylenediisocyanate;
1,6-Tetramethylenediisocyanate;
1,10-Decamethylenediisocyanate;
1,4-Cyclohexylenediisocyanate;
Xylylenediisocyanate;
4,4-Methylenebis(cyclohexylisocyanate);
1,5-Tetrahydronaphthalenediisocyanate; etc.

Resins which can be used preferably in the present invention may be obtained from the polysiloxanes of the general formula (I) and the above-described organic polyisocyanates in accordance with a suitable process known conventionally for the preparation of polyurethane resins. Where X is a hydroxyl group in the general formula (I) for example, polyurethane resins containing siloxane bonds are obtained. Polyurea resins are obtained where X is an amino group. Polyurethane polyurea resins are obtained, when a polysiloxane of the general formula (I) in which X is a hydroxyl group and another polysiloxane of the general formula (I) in which X is an amino group are used at desired ratios.

Anyhow, it is preferable, especially, for the attainment of the objects of this invention to conduct the above reaction in such a way that the proportion of silicon atoms in a resin to be obtained will amount to about 5–50 parts by weight of 100 parts by weight of the resin.

The proportion of silicon atoms may be controlled to the above range by regulating the average molecular weight of a polysiloxane of the general formula (I) to be used, or by using together with a polysiloxane of the general formula (I) a usual organic diamine, for example, ethylenediamine, propylenediamine, butylenediamine, hexamethylenediamine, phenylenediamine or the like and further another polyol such as ethylene glycol, propylene glycol, polyether polyol, polyester polyol or the like.

If the proportion of silicon atoms in the resulting resin is smaller than about 5 wt. %, the resulting heat-resistant layer will have insufficient heat resistance. On the other hand, any proportions of silicon atoms in excess of 50 wt. % will result in polyurethane resins and/or polyurea resins having reduced solubility in organic solvents and lowered flexibility. These polyurethane resins and/or polyurea resins are not preferred as resins for forming heat-resistant layers.

The preparation of polyurethane resins or polyurea resins out of the above-exemplified resins can be achieved in accordance with a process known conventionally for the preparation of polyurethane resins or polyurea resins. A polyurethane resin and/or polyurea resin which can be used suitably in the present invention can be obtained, for example, by reacting the above components in the presence or absence of an organic solvent and/or a catalyst at about 0°–100° C. for about 0.5–3 hours.

It is preferable to carry out the preparation process in such an organic solvent that can dissolve a polyurethane resin and/or polyurea resin to be formed.

On the other hand, polyamide resins and polyester resins, which contain siloxane bonds, can be obtained in accordance with processes known to date.

The heat-sensitive recording medium of this invention can be obtained in exactly the same manner as known to date except for the use of any one of various resins such as those mentioned above, preferably, a polyurethane resin and/or polyurea resin for the formation of its heat-resistant layer. For example, the heat-sensitive recording layer may be formed by adding a binder resin, which is known conventionally for the formation of heat-sensitive recording layers, together with a dye or pigment and optionally a dispersant into an organic solvent to prepare a dispersion, coating a base material with the dispersion and then drying the thus-coated base material.

Any conventionally-known organic solvent, dye or pigment, and base material may be used in the above preparation. Their coating, drying and the like may be effected by methods also known to date.

As the binder resin for example, may be used a vinyl chloride/vinyl acetate copolymer, cellulose resin, epoxy resin, polyvinyl butyral resin, polyurethane resin, synthetic rubber resin, acrylic resin, polyester resin or the like.

As preferable exemplary organic solvents, may be mentioned methyl ethyl ketone, methyl n-propyl ketone, methyl isobutyl ketone, diethyl ketone, methyl formate, ethyl formate, propyl formate, methyl acetate, ethyl acetate, butyl acetate, acetone, tetrahydrofuran, dioxane, methanol, ethanol, isopropyl alcohol, butanol, methyl cellosolve, butyl cellosolve, cellosolve acetate, dimethylformamide, dimethylsulfoxide, pentane, hexane, cyclohexane, heptane, octane, mineral spirit, petroleum ether, gasoline, benzene, toluene, xylene, chloroform, carbon tetrachloride, chlorobenzene, perchloroethylene, and trichloroethylene.

As the dye or pigment, any dye or pigment known conventionally may be used. Illustrative examples of the pigment may include organic pigments such as azo, phthalocyanine, quinacridone and polycyclic pigments as well as inorganic pigments such as carbon black, iron oxide, chrome yellow and cadmium sulfide. As exemplary dyes, may be mentioned sublimable dyes and disperse dyes known to date.

The binder resin may be used preferably in a proportion of about 10–40 parts by weight per 100 parts by weight of such a dye or pigment, so that the solid content of the resulting coating formulation falls within a range of about 20–40 wt. %.

Conventional sheet-like base materials are all usable in the present invention. For example, 5–50 μm thick polyester films, polypropylene films, cellulose triacetate films, cellulose diacetate films, polycarbonate films and the like can be used as desired.

The heat-sensitive recording layer can be formed by applying a coating formulation such as that mentioned above onto one side of such a base material as described above by a desired method to a thickness sufficient to give a dry thickness of about 5–50 μm and then drying the thus-coated base material.

The heat-sensitive recording medium of this invention can thereafter be obtained by forming a heat-resistant layer with a specific resin as mentioned above, preferably, a polyurethane resin and/or polyurea resin on the back side of the heat-sensitive recording medium obtained in a manner known to date as described above.

The formation of such a heat-resistant layer is effected by dissolving the above-described resin, preferably, a polyurethane resin and/or polyurea resin to a concentration of about 0–50 wt. % in such an organic solvent as described above to form a coating formulation, applying the coating formulation to the back side of a base material to a thickness sufficient to give a dry thickness of about 5–50 μm or so, and then drying the thus-coated base material.

The application of the coating formulation can be carried out by using any one of various coating methods known to date. The drying is effected at about 50°–120° C. for about 0.5–2 hours.

In addition to the specific resin employed above, preferably, a polyurethane resin and/or polyurea resin, one or more of resins which have been used conventionally, such as a polyurethane resin and/or polyester may also be used in combination in order to adjust the Young's modulus and/or adhesion. It is also feasible to add one or more of various additives, such as antistatic agent.

In the above described, each heat-sensitive layer was formed prior to the formation of its associated heat-resistant layer. The same effects can also be brought about even when a heat-sensitive recording layer is formed after the formation of its associated heat-resistant layer.

The present invention will hereinafter be described more specifically by the following Referential Examples, Examples, Comparative Examples and Application Example, in which all designations of "part" or "parts" and "%" refer to part or parts by weight and wt. %.

EXAMPLE 1 (SYNTHESIS OF POLYUREA RESIN)

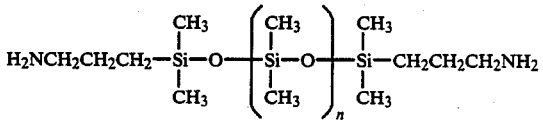

Added to 250 parts of dimethylforamide were 150 parts of a dimethylpolysiloxanediamine of the above formula (average molecular weight: 3,880) and 10 parts of 1,3-propylenediamine. The resultant liquid mixture was charged in a reactor equipped with a stirrer, reflux condenser, dropping funnel and gas ebullator. The contents were externally cooled to maintain the internal temperature within a range of 0°–5° C. While maintaining this temperature, carbon dioxide gas was continuously fed through the ebullator.

Then, a solution of 15 parts of hydrogenated MDI in 65 parts of dimethylformamide was added dropwise into the reactor through the dropping funnel so as to conduct a reaction. After completion of the dropwise addition, the internal temperature was raised gradually. When the internal temperature reached 50° C., the contents were continuously stirred at the same temperature for 1 hour.

A liquid polyurea resin mixture thus obtained had a solid content of 35% and its viscosity was 15,000 cps (at 25° C).

The strength at break (kg/cm), elongation at break (%) and softening point of a film formed from the liquid mixture were 450, 550 and at least 150° C. respectively.

EXAMPLE 2 (SYNTHESIS OF POLYUREA RESIN)

A liquid polyurea resin mixture was obtained in the same manner as in Example 1 except that 150 parts of a polysiloxanediamine, which was similar to that used in Example 1 but had an average molecular weight of about 1,000, were added to a mixed organic solvent composed of 100 parts of dimethylformamide and 150 parts of methyl ethyl ketone and a solution of 39 parts of hydrogenated MDI in 100 parts of methyl ethyl ketone was used.

The solid content and viscosity of the liquid mixture were 35% and 10,000 cps (at 25° C.).

The strength at break (kg/cm), elongation at break (%) and softening point of a film formed from the liquid mixture were 210, 650 and at least 150° C. respectively.

EXAMPLE 3 (SYNTHESIS OF POLYUREA RESIN)

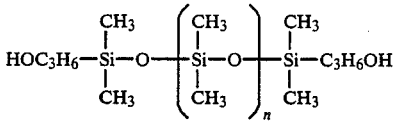

A liquid mixture of a polyurethane resin containing siloxane bonds was prepared in the same manner as in Example 1 except that 150 parts of a polydimethylsiloxanediol represented by the above formula and having an average molecular weight of about 3,200 and 10 parts of 1,4-butanediol were added to a mixed organic solvent composed of 200 parts of methyl ethyl ketone and 50 parts of dimethylforamide and a solution of 40 parts of hydrogenated MDI in methyl ethyl ketone was used.

The liquid mixture had a solid content of 35% and its viscosity was 14,700 cps (at 25° C.).

The strength at break (kg/cm), elongation at break (%) and softening point of a film formed from the liquid mixture were 200, 560 and at most 100° C. respectively.

EXAMPLE 4 (SYNTHESIS OF POLYURETHANE RESIN)

A liquid mixture of a polyurethane resin containing siloxane bonds was obtained in the same manner as in Comparative Example 1 except that 150 parts of a polydimethylsiloxanediol, which had the same structure as that in Comparative Example 1 but had an average molecular weight of about 1,000, were added to 250 parts of methyl ethyl ketone and 39 parts of hydrogenated MDI were dissolved in 100 parts of methyl ethyl ketone.

The solid content and viscosity of the liquid mixture were 35% and 11,600 cps (at 25° C.).

The strength at break (kg/cm), elongation at break (%) and softening point of a film formed from the liquid mixture were 90, 700 and at most 100° C. respectively.

EXAMPLE 5 (SYNTHESIS OF POLYAMIDE CONTAINING SILOXANE BONDS)

To 200 ml of a solution of 14.6 parts of adipic acid in absolute ethanol, 100 ml of an absolute ethanol solution of 388 parts of the same polysiloxanediamine as that employed in Example 1 was added at room temperature. After generation of heat, the reaction mixture was allowed to cool down so that a nylon salt precipitated. After collection by filtration and drying under reduced pressure, 160 parts of the nylon salt were taken up in 40 parts of water. The resulting aqueous solution was placed in an autoclave. The container of the autoclave was purged with nitrogen gas and the valve was closed. When the internal temperature and pressure reached 220° C. and 18 kg/cm$^2$ respectively, the valve was opened a little to release steam. The contents were continuously heated while maintaining this pressure. Polycondensation was conducted for 4 hours at this pressure. Thereafter, the pressure was reduced little by little to normal pressure. During this period, the internal temperature was raised to 275° C. at which the contents were heated for further 30 minutes. After cooling the autoclave, the reaction mixture was taken out and dissolved in a mixed cresol of m-cresol and p-cresol to obtain a viscous liquid mixture.

The solid content, viscosity and intrinsic viscosity of the liquid mixture were 20%, 1.200 cps (at 30° C.) and 0.83.

The strength at break (kg/cm), elongation at break (%) and softening point of a film formed from the liquid mixture were 520, 230 and at most 225° C. respectively.

COMPARATIVE EXAMPLE 1 (SYNTHESIS OF CONVENTIONALLY-KNOWN POLYURETHANE RESIN)

A liquid polyurethane resin mixture was obtained in the same manner as in Example 1 except that 150 parts of a polydimethylsiloxanediol having an average molecular weight of about 2,000 and 10 parts of 1,4-butanediol were added to a mixed organic solvent composed of 120 parts of methyl ethyl ketone and 130 parts of dimethylformamide and 47 parts of hydrogenated MDI were dissolved in 135 parts of methyl ethyl ketone.

The solid content and viscosity of the liquid mixture were 35% and 14,500 cps (at 25° C.).

The strength at break (kg/cm), elongation at break (%) and softening point of a film formed from the liquid mixture were 250, 500 and at most 100° C. respectively.

Incidentally, the softening points in the above Examples and Comparative Examples were determined in the following manner. Each film was cut into an elongated rectangular shape. A weight was attached to the lower end of the film to apply a gravity of 450 g/cm$^2$. The film with the weight attached thereto was suspended in a Geer oven and the temperature was raised at a rate of 2° C./min. Its softening point was determined as a temperature at which the elongation of the film increased suddenly or the film was cut off.

EXAMPLES 6–10 AND COMPARATIVE EXAMPLES 2–3

Coating formulations containing the following components in the following compositions were prepared separately. They were separately applied to the back sides of 15-μm thick polyester films, each of which had been provided on the front side thereof with a heat-sensitive recording layer in advance, by the gravure coating method to give a dry coat thickness of 0.6 μm. The solvent was driven off in an oven, thereby forming heat-resistant layers.

The thus-obtained heat-sensitive recording media were cut into a predetermined width, thereby producing heat-sensitive recording media of this invention and comparative heat-sensitive recording media.

| | |
|---|---|
| Example 6 | |
| Liquid resin mixture of Example 1 | 100 parts |
| Methyl ethyl ketone | 100 parts |
| Example 7 | |
| Liquid resin mixture of Example 2 | 100 parts |
| Methyl ethyl ketone | 100 parts |
| Example 8 | |
| Liquid resin mixture of Example 3 | 100 parts |
| Methyl ethyl ketone | 100 parts |
| Example 9 | |
| Liquid resin mixture of Example 4 | 100 parts |
| Methyl ethyl ketone | 100 parts |
| Example 10 | |
| Liquid resin mixture of Example 5 | 100 parts |
| Methyl ethyl ketone | 100 parts |
| Comparative Example 2 | |
| Liquid resin mixture of Comp. Ex. 1 | 100 parts |
| Methyl ethyl ketone | 100 parts |
| Comparative Example 3 | |

-continued

| | |
|---|---|
| Liquid resin mixture of Comp. Ex. 1 | 100 parts |
| Talc | 10 parts |
| Methyl ethyl ketone | 123 parts |

Evaluation

Properties of the heat-sensitive recording media obtained in Examples 6–10 and Comparative Examples 2–3 were as follows.

TABLE 1

| Properties Recording medium | Friction coefficient | Sticking tendency | Head smearing | Printability |
|---|---|---|---|---|
| Example 6 | 0.20 | 5 | 5 | 5 |
| Example 7 | 0.25 | 4 | 5 | 5 |
| Example 8 | 0.21 | 5 | 5 | 5 |
| Example 9 | 0.22 | 5 | 5 | 5 |
| Example 10 | 0.24 | 4 | 4 | 5 |
| Comp. Ex. 2 | 0.50 | 2 | 5 | 5 |
| Comp. Ex. 3 | 0.40 | 3 | 1 | 1 |

Each friction coefficient in the above Table 1 indicates a value measured between an untreated surface of polyethylene terephthalate and the heat-resistant layer formed in the corresponding Example or Comparative Example.

Sticking tendency was ranked in 5 stages, the lowest sticking tendency receiving a "5", by visually observing the separability of each heat-sensitive recording medium from a thermal head when the heat-sensitive recording medium was subjected to an actual recording test.

Head smearing was ranked in 5 stages, the least smearing receiving a "5", by subjecting each heat-sensitive recording medium to an actual recording test and observing the degree of smearing of a thermal head.

Printability is a property which has significance upon production of a heat-sensitive recording medium. Upon application of a coating formulation on a sheet-like base material by the gravure coating method, the degree of clogging of a printing plate was observed. Results were ranked in 5 stages, the least clogging receiving a "5".

It is clear from Table 1 that the heat-sensitive recording media according to this invention, which employed the resins containing siloxane bonds, especially, the siloxane-bond-containing polyurethane resins and siloxane-bond-containing polyurea resins respectively, are superior in frictional coefficient, sticking tendency, head smearing and printability compared with heat-sensitive recording media making use of conventional polyurea resins.

Having now fully described the invention, it will be apparent to one of ordinary skill in the art that many changes and modifications can be made thereto without departing from the spirit or scope of the invention as set forth herein.

We claim:

1. In a heat-sensitive recording medium composed of a base sheet, a heat-sensitive ink-transfer recording layer provided on one side of the base sheet and a heat-resistant layer provided on the other side of the base sheet, the improvement wherein the heat-resistant layer is made of a resin containing siloxane bonds in its molecule, said resin being selected from the group consisting of polyurethane and polyurea resins.

2. The recording medium of claim 1, wherein the resin containing siloxane bonds is a polyurethane resin.

3. The recording medium of claim 1, wherein the resin containing siloxane bonds is a polyurea resin.

* * * * *